US009102894B2

(12) United States Patent
Shibata et al.

(10) Patent No.: US 9,102,894 B2
(45) Date of Patent: Aug. 11, 2015

(54) RUST-PREVENTIVE OIL COMPOSITION

(75) Inventors: Junichi Shibata, Tokyo (JP); Tadaaki Motoyama, Tokyo (JP); Kazuhiko Endou, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 103 days.

(21) Appl. No.: 13/256,840

(22) PCT Filed: Dec. 10, 2009

(86) PCT No.: PCT/JP2009/070662

§ 371 (c)(1),
(2), (4) Date: Sep. 15, 2011

(87) PCT Pub. No.: WO2011/001554

PCT Pub. Date: Jan. 6, 2011

(65) Prior Publication Data

US 2012/0010111 A1 Jan. 12, 2012

(30) Foreign Application Priority Data

Jun. 29, 2009 (JP) ..... 2009-153902

(51) Int. Cl.

| | |
|---|---|
| ***C10M 141/02*** | (2006.01) |
| ***C10M 141/06*** | (2006.01) |
| ***C10M 133/16*** | (2006.01) |
| ***C10M 141/00*** | (2006.01) |
| ***C10M 161/00*** | (2006.01) |
| ***C23F 11/10*** | (2006.01) |
| ***C23F 11/12*** | (2006.01) |
| ***C23F 11/14*** | (2006.01) |
| ***C23F 11/16*** | (2006.01) |
| ***C23F 11/173*** | (2006.01) |

(52) U.S. Cl.

CPC ..... *C10M 133/16* (2013.01); *C10M 141/00* (2013.01); *C10M 161/00* (2013.01); *C23F 11/10* (2013.01); *C23F 11/126* (2013.01); *C23F 11/128* (2013.01); *C23F 11/141* (2013.01); *C23F 11/144* (2013.01); *C23F 11/163* (2013.01); *C23F 11/173* (2013.01); *C10M 2201/02* (2013.01); *C10M 2203/1006* (2013.01); *C10M 2205/0285* (2013.01); *C10M 2205/12* (2013.01); *C10M 2205/16* (2013.01); *C10M 2207/026* (2013.01); *C10M 2207/126* (2013.01); *C10M 2207/22* (2013.01); *C10M 2207/283* (2013.01); *C10M 2207/288* (2013.01); *C10M 2207/289* (2013.01); *C10M 2207/40* (2013.01); *C10M 2209/104* (2013.01); *C10M 2215/042* (2013.01); *C10M 2215/044* (2013.01); *C10M 2215/08* (2013.01); *C10M 2215/22* (2013.01); *C10M 2215/223* (2013.01); *C10M 2219/044* (2013.01); *C10N 2210/01* (2013.01); *C10N 2210/02* (2013.01); *C10N 2220/022* (2013.01); *C10N 2230/02* (2013.01); *C10N 2230/12* (2013.01); *C10N 2230/66* (2013.01); *C10N 2240/02* (2013.01); *C10N 2240/408* (2013.01)

(58) Field of Classification Search

USPC ..... 508/390, 410, 513, 579

See application file for complete search history.

(56) References Cited

U.S. PATENT DOCUMENTS

| | | | | |
|---|---|---|---|---|
| 4,195,977 | A * | 4/1980 | Newman | 44/406 |
| 4,402,747 | A * | 9/1983 | Bird et al. | 106/14.42 |
| 4,464,275 | A | 8/1984 | Yasui | |
| 4,518,512 | A * | 5/1985 | Kanamori | 508/389 |
| 4,536,307 | A * | 8/1985 | Horodysky | 508/194 |
| 4,536,311 | A * | 8/1985 | Horodysky | 508/242 |
| 5,131,921 | A * | 7/1992 | Sung et al. | 44/391 |
| 5,227,083 | A * | 7/1993 | Russo et al. | 508/476 |
| 5,578,557 | A * | 11/1996 | Dougan et al. | 508/437 |
| 5,599,779 | A * | 2/1997 | Karol et al. | 508/283 |
| 5,932,526 | A * | 8/1999 | Person Hei et al. | 508/559 |
| 5,958,850 | A * | 9/1999 | Matsuzaki et al. | 508/435 |
| 6,410,490 | B1 * | 6/2002 | Reyes-Gavilan et al. | 508/243 |
| 6,750,185 | B2 * | 6/2004 | Ryu et al. | 508/485 |
| 7,176,168 | B2 * | 2/2007 | Vann et al. | 508/253 |
| 8,303,850 | B2 * | 11/2012 | Shibata et al. | 252/388 |
| 8,394,746 | B2 * | 3/2013 | Carey et al. | 508/438 |
| 2004/0214733 | A1 * | 10/2004 | Baba | 508/430 |
| 2009/0111723 | A1 | 4/2009 | Shibata et al. | |
| 2009/0247436 | A1 * | 10/2009 | Wardlow et al. | 508/304 |

(Continued)

FOREIGN PATENT DOCUMENTS

| | | |
|---|---|---|
| EP | 2 314 736 | 4/2011 |
| JP | 2000-239868 | 9/2000 |
| JP | 2002-302690 | 10/2002 |
| JP | 2007-39764 | 2/2007 |

(Continued)

OTHER PUBLICATIONS

Search Report issued with respect to patent-family member European Patent Application No. 09846845.7, mailed Nov. 28, 2012.

English translation of International Preliminary Report on Patentability for PCT/JP2009/070662, mailed Feb. 23, 2012.

Search report from International Application No. PCT/JP2009/070662, mail date is Jan. 19, 2010.

*Primary Examiner* — Ellen McAvoy

(74) *Attorney, Agent, or Firm* — Greenblum & Bernstein, P.L.C.

(57) ABSTRACT

A rust preventive oil composition comprising a nonionic surfactant with a hydrophilic-lipophilic index of 10-12 at 0.1-10% by mass based on the total amount of the composition, and at least one rust-preventing additive selected from among sarcosine compounds, sulfonic acid salts, esters, amines, carboxylic acids, fatty acid amine salts, carboxylic acid salts, paraffin waxes, oxidized wax salts, alkyl or alkenylsuccinic acid derivatives and boron compounds, the composition having a 40° C. kinematic viscosity of 1-50 $mm^2/s$.

7 Claims, No Drawings

(56) References Cited

U.S. PATENT DOCUMENTS

| | | | | |
|---|---|---|---|---|
| 2010/0105585 | A1* | 4/2010 | Carey et al. | 508/162 |
| 2011/0101280 | A1* | 5/2011 | Motoyama et al. | 252/401 |
| 2011/0118157 | A1* | 5/2011 | Cook et al. | 508/243 |

FOREIGN PATENT DOCUMENTS

| | | |
|---|---|---|
| JP | 2007-262543 | 10/2007 |
| WO | 2007/114505 | 10/2007 |
| WO | 2009/145240 | 12/2009 |

* cited by examiner

RUST-PREVENTIVE OIL COMPOSITION

TECHNICAL FIELD

The present invention relates to a rust preventive oil composition.

BACKGROUND ART

The major causes of metal rusting are known to be oxygen and moisture, while sodium chloride is also a known cause of rust. This is obvious from the experience that metal products are prone to corrosion near coastal areas. On the other hand, in the fields of metal members including steel sheets, bearings, steel balls and guide rails, assembly of parts by hand leads to attachment of chloride and other rust-generating factors, resulting in generation of rust. Countermeasures are therefore taken, such as cleaning removal of rust-causing factors, and the use of rust preventive oil lubricants.

Rust preventive oils commonly contain rust preventive additives (corrosion inhibitors) such as metal sulfonates, sulfonic acid amines, carboxylic acids, esters, amines and the like, but when the target of treatment is to be stored for prolonged periods, the rust preventive effect is often insufficient with rust preventive additives (corrosion inhibitors) alone. Thus, it has been proposed to use rust preventive oils containing heavy components such as waxes and petrolatum in addition to the aforementioned rust preventive additives, to further increase the rust-preventing property by thickening the rust preventive oil coating film. Such coating films block oxygen and moisture that are externally-derived causes of rust (see Patent document 1, for example).

Also, rust preventive oils containing heavy components such as waxes are associated with problems such as increased volume due to higher viscosity, impaired degreasing properties and decreased sprayability during spray coating, and therefore methods of maintaining the rust-preventing property by adding sarcosine compounds and without adding heavy components such as waxes have been proposed (see Patent document 2, for example).

For conventional metal working steps, there have been proposed cleaning/rust preventive additive compositions that serve both for cleaning and rust-prevention, in order to unify the two steps of washing and rust-prevention into a single step (see Patent document 3).

CITATION LIST

Patent Literature

[Patent document 1] Japanese Unexamined Patent Application Publication No. 2002-302690

[Patent document 2] Japanese Unexamined Patent Application Publication No. 2007-039764

[Patent document 3] Japanese Unexamined Patent Application Publication No. 2007-262543

DISCLOSURE OF THE INVENTION

Problems to be Solved by the Invention

In techniques of the prior art, however, it is still difficult to maintain excellent rust preventive performance for prolonged periods, when factors that cause rust generation have attached to metal worked parts and manually mounted metal parts. It is therefore desirable to develop a rust preventive oil that maintains rust preventive performance for longer periods.

The present invention has been accomplished in light of these circumstances, and its object is to provide a rust preventive oil composition that can inhibit rust generation for prolonged periods without a cleaning step in which rust-causing factors are removed, when rust-causing factors become attached to various metal worked parts such as steel sheets, bearings, steel balls, guide rails or the like, and metal parts that are mounted by hand.

Means for Solving the Problems

In order to solve the problems described above, it is first necessary to remove and detach rust-causing factors from the metal surface, and a lower-viscosity rust preventive oil is generally preferred for this purpose. The rust-preventing property, on the other hand, is more satisfactory with a higher viscosity of the rust preventive oil, since the oil film is thicker. Also, for detachment of highly polar and ionic rust-causing factors from the metal surface it is necessary to incorporate an ionic substance into the rust preventive oil, and the presence of a surfactant and water is indispensable.

As a result of much diligent research with the aim of solving the aforementioned problems, the present inventors have discovered a rust preventive oil composition which does not exist in the prior art, and which maintains rust preventive performance for prolonged periods even when adhering rust-causing factors remain on various metal worked parts or manually mounted metal parts, by combining a specific nonionic surfactant and a specific rust preventive additive as additives in the composition, and the invention has been completed upon this discovery.

Specifically, the rust preventive oil composition of the invention comprises a lubricant base oil, a nonionic surfactant with a hydrophilic-lipophilic index of 10-12 and with an amount of 0.1-10% by mass based on the total amount of the composition, and at least one rust preventive additive selected from among sarcosine compounds, sulfonic acid salts, esters, amines, carboxylic acids, fatty acid amine salts, carboxylic acid salts, paraffin waxes, oxidized wax salts, alkyl or alkenylsuccinic acid derivatives and boron compounds, the composition having a 40° C. kinematic viscosity of 1-50 $mm^2/s$.

The hydrophilic-lipophilic index referred to here is the index of the mass ratio of the hydrophilic group portion to surfactant molecules, and it is calculated by the following formula.

Hydrophilic-lipophilic index=(molecular weight of hydrophilic group portion÷molecular weight of total surfactant)×100÷5

The term "lipophilic group portion", for the purpose of the invention, refers to hydrocarbon groups such as alkyl and cycloalkyl. The hydrophilic group portion is the residue remaining after removing the lipophilic group portion from the surfactant molecules, and in the case of the surfactant represented below, for example, the portion surrounded by the dotted line in the formula is the hydrophilic group portion.

[Chemical Formula 1]

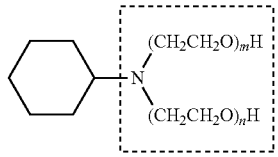

-continued

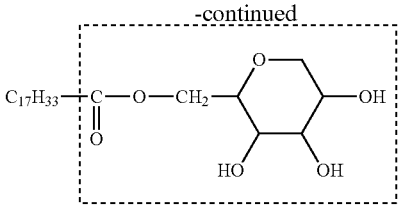

The rust preventive oil composition of the invention can exhibit excellent rust preventive performance even when water, that has traditionally been the most notable rust-causing factor, has contaminated the composition by absorption of moisture from the atmosphere. That is, when the rust preventive oil composition of the invention contacts with air, the aforementioned specific nonionic surfactant absorbs moisture in the air, becoming naturally hydrated, so that the function of the specific rust preventive additive is increased and excellent rust preventive performance is exhibited as a result.

According to the invention, the lubricant base oil preferably comprises a mineral oil and/or synthetic oil with a 40° C. kinematic viscosity of 0.7-40 $mm^2/s$, and a mineral oil and/or synthetic oil with a 40° C. kinematic viscosity of 150-700 $mm^2/s$.

The nonionic surfactant is preferably at least one type selected from among polyethylene glycol-type nonionic surfactants and polyhydric alcohol-type nonionic surfactants.

The nonionic surfactant is preferably at least one selected from among sorbitan fatty acid esters or oxyethylenealkylamines and polyoxyethylenealkylamines represented by the following formula (1):

$$R_a—N—[(C_2H_4O)_b—H]_c \quad (1)$$

wherein R represents a C1-24 hydrocarbon group, a and c are each 1 or 2, with the proviso that a+c=3, and b represents an integer of 1-7.

The rust preventive oil composition of the invention may comprise a sulfonic acid salt as a rust preventive additive, and the sulfonic acid salt is preferably at least one selected from among amine sulfonate, sodium sulfonate, calcium sulfonate and barium sulfonate.

The rust preventive oil composition of the invention may also contain water with an amount of 0.1-10% by mass based on the total amount of the composition.

Effect of the Invention

According to the invention, as mentioned above, addition of a specific rust preventive additive can inhibit rust generation for prolonged periods without a special cleaning step in which rust-causing factors are removed, when rust-causing factors remain that have become attached to metal parts such as steel sheets, bearings, steel balls and guide rails after manual mounting.

BEST MODES FOR CARRYING OUT THE INVENTION

Preferred modes of the invention will now be explained.

A mineral oil and/or synthetic oil may be used as the lubricant base oil in the rust preventive oil composition of the invention.

The mineral oil may be, specifically, a paraffin-based or naphthene-based mineral oil obtained by applying an appropriate combination of one or more refining means such as solvent deasphalting, solvent extraction, hydrotreatment, solvent dewaxing, catalytic dewaxing, hydrorefining, sulfuric acid washing or white clay treatment, on a lube-oil distillate obtained from atmospheric distillation and vacuum distillation of crude oil.

The synthetic oil used is preferably a polyolefin, alkylbenzene or the like.

Polyolefins include homopolymerized or copolymerized C2-16 and preferably C2-12 olefin monomers, and hydrogenated forms of such polymers.

The polyolefin may be produced by a method known in the prior art. Polyolefins obtained by processes known in the prior art usually have double bonds, but according to the invention, it is preferred to use a polyolefin having the double bonded carbons hydrogenated, i.e. a hydrogenated polyolefin, as the base oil. Using a hydrogenated polyolefin will tend to improve the heat and oxidation stability of the rust preventive oil composition that is obtained.

According to the invention, the lubricant base oil in the rust preventive oil composition preferably comprises a mineral oil and/or synthetic oil with a 40° C. kinematic viscosity of 0.7-40 $mm^2/s$, and a mineral oil and/or synthetic oil with a 40° C. kinematic viscosity of 150-700 $mm^2/s$.

The content of the lubricant base oil in the rust preventive oil composition of the invention is not particularly restricted, but it is preferably 50% by mass or greater, more preferably 60% by mass or greater and even more preferably 70% by mass or greater based on the total amount of the composition.

The rust preventive oil composition of the invention also comprises (A) a nonionic surfactant with a hydrophilic-lipophilic index of 10-12. The rust-preventing property will be insufficient with a hydrophilic-lipophilic index of either less than 10 or greater than 12.

The nonionic surfactant used may be of any type having a hydrophilic-lipophilic index of 10-12, but preferred for use are polyhydric alcohol-type nonionic surfactants or ethylene glycol-type nonionic surfactants, and polyethylene glycol-type nonionic surfactants, among which sorbitan fatty acid esters or oxyethylenealkylamines and polyoxyethylenealkylamines represented by formula (1) are more preferably used. In particular, oxyethylenealkylamines and polyoxyethylenealkylamines represented by formula (1) are most preferably used.

$$R_a—N—[(C_2H_4O)_b—H]_c \quad (1)$$

[In the formula, R represents a C1-24 hydrocarbon group, a and c are each 1 or 2, with the proviso that a+c=3, and b represents an integer of 1-7.]

Specific examples of polyoxyethylenealkylamines include (di)polyoxyethylenemonocyclohexylamine and (mono)polyoxyethylenedicyclohexylamine. Among such examples, (di)polyoxyethylenemonocyclohexylamine and (mono)polyoxyethylenedicyclohexylamine are preferred for use.

Specific examples of oxyethylenealkylamines include (di)oxyethylenemonocyclohexylamine and (mono)oxyethylenedicyclohexylamine. Among such examples, (di)oxyethylenemonocyclohexylamine and (mono)oxyethylenedicyclohexylamine are preferred for use.

Sorbitan fatty acid esters include esters of sorbitan and fatty acids such as capric acid, lauric acid, myristic acid, pentadecylic acid, palmitic acid, palmitoyl acid, stearic acid, oleic acid, vaccenic acid, linolic acid and linolenic acid, including monoesters, diesters and triesters.

The content of the nonionic surfactant with a hydrophilic-lipophilic index of 10-12 in the rust preventive oil composition of the invention is 0.1-10% by mass, preferably 0.5-8% by mass and more preferably 1.0-6% by mass based on the total amount of the composition, from the viewpoint of the rust-preventing property.

Specific examples of other nonionic surfactants include alkylene glycols, polyoxyalkylene glycols, polyoxyalkylenealkyl ethers, polyoxyalkylenearyl ethers, alkylphenolethylene oxide addition products, higher alcohol ethylene oxide addition products, polyoxyalkylene fatty acid esters, glycerin, and pentaerythritol fatty acid esters, sucrose fatty acid esters, fatty acid esters of polyhydric alcohol polyoxyalkylene addition products, alkylpolyglycosides, and fatty acid alkanolamides. Preferred among these are alkylene glycols, polyoxyalkylene glycols, polyoxyalkylenealkyl ethers and polyoxyalkylenearyl ethers, for a more excellent rust-preventing property of the rust preventive oil composition of the present application.

The rust preventive oil composition of the invention comprises, as a rust preventive additive, at least one selected from among (B1) sarcosine compounds, (B2) sulfonic acid salts, (B3) esters, (B4) amines, (B5) carboxylic acids, (B6) fatty acid amine salts, (B7) carboxylic acid salts, (B8) paraffin waxes, (B9) oxidized wax salts, (B10) alkyl or alkenylsuccinic acid derivatives and (B11) boron compounds.

A (B1) sarcosine compound has a structure represented by the following formula (2), (3) or (4):

$$R^1—CO—NR^2—(CH_2)_n—COOX \quad (2)$$

$$[R^1—CO—NR^2—(CH_2)_n—COO]_mY \quad (3)$$

$$[R^1—CO—NR^2—(CH_2)_n—COO]_m—Z—(OH)_{m'} \quad (4)$$

wherein $R^1$ represents a C6-30 alkyl or C6-30 alkenyl group; $R^2$ represents a C1-4 alkyl group; X represents hydrogen or a C1-30 alkyl or C1-30 alkenyl group; Y represents an alkali metal or alkaline earth metal; Z represents a residue remaining after removal of a hydroxyl group from a divalent or greater polyhydric alcohol; m represents an integer of 1 or greater, which is 1 when Y is an alkali metal and 2 when it is an alkaline earth metal; m' represents an integer of 0 or greater; n represents an integer of 1-4, and m+m' is the valency of Z.

$R^1$ must be a C6 or greater alkyl or alkenyl group, from the viewpoint of solubility in the lubricant base oil, and it is preferably C7 or greater and more preferably C8 or greater. From the viewpoint of storage stability, it must be a C30 or lower alkyl or alkenyl group, and is preferably C24 or lower and more preferably C20 or lower.

From the viewpoint of storage stability, $R^2$ must be a C4 or lower alkyl or alkenyl group, and is preferably C3 or lower and more preferably C2 or lower. From the viewpoint of storage stability, n must be an integer of no greater than 4, and is preferably an integer of no greater than 3 and more preferably an integer of no greater than 2.

From the viewpoint of storage stability, the alkyl or alkenyl group represented by X must be C30 or lower, and is preferably C20 or lower and more preferably C10 or lower. From the viewpoint of a more excellent rust-preventing property, it is preferably an alkyl group. From the viewpoint of a more excellent rust-preventing property, X is preferably hydrogen or a C1-20 alkyl or C1-20 alkenyl group, more preferably hydrogen or a C1-20 alkyl group, and even more preferably hydrogen or a C1-10 alkyl group.

Y represents an alkali metal or alkaline earth metal, with specific examples including sodium, potassium, magnesium, calcium and barium. It is preferably an alkaline earth metal from the viewpoint of a more excellent rust-preventing property. With barium, however, inadequate safety for the body and ecological systems may be a concern.

Z represents a residue remaining after removing a hydroxyl group from a divalent or greater polyhydric alcohol. Examples of such polyhydric alcohols include dihydric alcohols, trihydric alcohols, tetravalent alcohols, pentavalent alcohols, hexavalent alcohols and polyglycerin or dehydrating condensation products thereof.

In formula (4), m is an integer of 1 or greater, m' is an integer of 0 or greater, and m+m' is the same as the valency of Z. That is, all of the hydroxyl groups of the polyhydric alcohol of Z may be replaced, or only a portion thereof may be replaced.

From the viewpoint of obtaining a more excellent rust-preventing property, the preferred sarcosines represented by formulas (2)-(4) are one or more compounds selected from among those of formulas (2) and (3). A single compound selected from among formulas (2)-(4) may be used alone, or a mixture of 2 or more such compounds may be used.

Preferred examples of (B2) sulfonic acid salts include alkali metal sulfonates and alkaline earth metal sulfonates or amine sulfonates. Sulfonic acid salts all have sufficiently high safety for the body and ecological systems, and can be obtained by reaction with alkali metals, alkaline earth metals or amines with sulfonic acid.

Alkali metals in sulfonic acid salts include sodium and potassium, and sodium sulfonate is a specific example. Alkaline earth metals in the sulfonic acid salts include calcium and barium sulfonate. Calcium is preferred from the viewpoint of safety.

When the sulfonic acid salt is an amine salt, the amine may be a monoamine, polyamine, alkanolamine or the like.

Monoamines include monoalkylamines with a C1-13 alkyl group, dialkylamines with two C1-8 alkyl groups, trialkylamines with three C1-5 alkyl groups and trialkylamines with two methyl groups and one C2-13 alkyl group;

monoalkenylamines with a C1-13 alkenyl group, dialkenylamines with two C2-8 alkenyl groups and trialkenylamines with three C2-5 alkenyl groups;

dimethylmonoalkenylamines with two methyl groups and one C2-13 alkenyl group;

aromatic-substituted alkylamines, C5-16 cycloalkylamines, and monoamines or alkylcycloalkylamines with alkyl and cycloalkyl groups, as well as all substituted isomers of these monoamines. The term "monoamine" includes monoamines such as beef tallow amines derived from fats or oils.

Examples of polyamines include alkylenepolyamines such as ethylenediamine, diethylenetriamine, triethylenetetramine, tetraethylenepentamine, pentaethylenehexamine, propylenediamine, dipropylenetriamine, tripropylenetetramine, tetrapropylenepentamine, pentapropylenehexamine, butylenediamine, dibutylenetriamine, tributylenetetramine, tetrabutylenepentamine and pentabutylenehexamine; N-alkylethylenediamines with C1-23 alkyl groups; N-alkenylethylenediamines with C2-23 alkenyl groups; and N-alkyl or N-alkenylalkylenepolyamines, including all substituted isomers of these polyamines. The term "polyamine" also includes polyamines derived from fats or oils (beef tallow polyamines and the like).

Examples of alkanolamines include:

C1-16 alcohol monoalkanol monoamines,

C1-7 alcohol dialkanol monoamines, trialkanol monoamines with three C1-5 alcohols, monoalkyldialkanol monoamines with one C2-4 alkyl group and two C2-5 alcohols, dialkylmonoalkanol monoamines with two C2-4 alkyl groups and one C2-5 alcohol, monocyclohexylmonoalkanol monoamines with one cyclohexyl group and one C2 or C3 alcohol, and monocyclohexyldialkanol monoamines with one cyclohexyl group and two C2 or C3 alcohols, including all substituted isomers of these alkanolamines.

The sulfonic acid used may be a known type produced by a common method. Specifically, there may be mentioned synthetic sulfonic acids, including sulfonated alkyl aromatic compounds from mineral oil lube-oil distillates and petroleum sulfonic acids such as "mahogany acids" as by-products from white oil production, or sulfonated alkylbenzenes having straight-chain or branched-chain alkyl groups, obtained by or alkylation of benzene with polyolefins, as by-products in production plants for alkylbenzenes used as starting materials for detergents, or sulfonated alkylnaphthalenes such as dinonylnaphthalene.

Sulfonates obtained using these starting materials include the following, for example. Neutral (normal salt) sulfonates obtained by reacting alkali metal bases, such as alkali metal oxides or hydroxides, or amines such as ammonia, alkylamines or alkanolamines with sulfonic acid; basic sulfonates obtained by heating the aforementioned neutral (normal salt) sulfonates with excess alkali metal bases or amines in the presence of water; carbonate overbased sulfonates obtained by reacting neutral (normal salt) sulfonates with alkali metal bases or amines in the presence of carbon dioxide gas; and borate overbased sulfonates obtained by reacting the aforementioned neutral (normal salt) sulfonates with alkali metal bases or amines and boric acid compounds such as boric acid or boric anhydride, or by reacting carbonate overbased sulfonates with boric acid compounds such as boric acid or boric anhydride, as well as mixtures of the foregoing.

As sulfonic acid salts there are preferred at least one type selected from the group consisting of dialkylnaphthalenesulfonic acid salts having a total of 14-30 carbon atoms, with two alkyl groups bonded to a naphthalene ring; dialkylbenzenesulfonic acid salts having a total of 14-30 carbon atoms, with two alkyl groups bonded to the benzene ring, which are branched-chain alkyl groups, one being a straight-chain alkyl group and the other a side-chain methyl group; and monoalkylbenzenesulfonic acid salts having 15 or more carbon atoms, with an alkyl group bonded to a benzene ring.

According to the invention, there are preferably used one or more selected from among neutral, basic and overbased alkali metal sulfonates and alkaline earth metal sulfonates; and most preferably neutral or nearly neutral alkali metal sulfonates with base values of 0-50 mgKOH/g and preferably 10-30 mgKOH/g, and/or (over)basic alkali metal sulfonates with base values of 50-500 mgKOH/g and preferably 200-400 mgKOH/g.

The base value (base number) referred to here is the base value measured by the hydrochloric acid method according to JIS K 2501, "Petroleum products and lubricants—Determination of neutralization number", Section 6, usually containing 30-70% by mass of a diluent such as a lubricant base oil.

Of the sulfonic acid salts of the invention, there are preferred sodium sulfonate, amine sulfonates, calcium sulfonate and barium sulfonate, and especially sodium sulfonate, alkylenediamine sulfonates and calcium sulfonate.

When water is to be purposely added to the rust preventive oil composition of the invention, the sulfonic acid salt is preferably sodium sulfonate or an amine sulfonate, and most preferably sodium sulfonate or an alkylenediamine sulfonate.

The (B3) ester may be (B3-1) a partial ester of a polyhydric alcohol, (B3-2) an esterified oxidized wax or (B3-3) an esterified lanolin fatty acid.

A (B3-1) partial ester of a polyhydric alcohol is an ester with at least one of the hydroxyl groups of the polyhydric alcohol remaining as hydroxyl without being esterified, and the polyhydric alcohol starting material may be any desired one, although it has preferably 2-10 and more preferably 3-6 hydroxyl groups in the molecule, and preferably a C2-20 and more preferably C3-10 polyhydric alcohol is used. Of these polyhydric alcohols, it is preferred to use at least one polyhydric alcohol selected from the group consisting of glycerin, trimethylolethane, trimethylolpropane, pentaerythritol and sorbitan, and more preferably pentaerythritol or sorbitan is used.

The carboxylic acid in the partial ester may be any desired one, although the number of carbons of the carboxylic acid is preferably 2-30, more preferably 6-24 and even more preferably 10-22. The carboxylic acid may be a saturated carboxylic acid or unsaturated carboxylic acid, and it may be either a straight-chain carboxylic acid or a branched-chain carboxylic acid. Mixtures of the foregoing may also be mentioned, including all substituted isomers of the fatty acids.

From the viewpoint of solubility in base oils, there are preferred unsaturated carboxylic acids, such as oleic acid. From the viewpoint of stain resistance, there are preferred saturated fatty acids such as isostearic acid.

The carboxylic acid of a partial ester may be a hydroxycarboxylic acid. A hydroxycarboxylic acid may be a saturated carboxylic acid or unsaturated carboxylic acid, but it is preferably a saturated carboxylic acid from the viewpoint of stability. The hydroxycarboxylic acid may also be a straight-chain carboxylic acid or branched carboxylic acid, among which there are preferred straight-chain carboxylic acids, or C1 or C2, and preferably C1 branched chain carboxylic acids, i.e. having 1-3, more preferably 1-2 and most preferably 1 methyl group.

The starting material containing such a hydroxycarboxylic acid is preferably a lanolin fatty acid obtained by purification of a waxy substance that adheres to sheep wool, by hydrolysis or the like. When a hydroxycarboxylic acid is used as the carboxylic acid of the partial ester, a carboxylic acid without hydroxyl groups may be used in combination therewith.

There are no particular restrictions on the number of carboxylic acid groups in an unsaturated carboxylic acid without hydroxyl groups, and it may be either a monobasic acid or polybasic acid, with monobasic acids being preferred. Among unsaturated carboxylic acids without hydroxyl groups, there are preferred C18-22 straight-chain unsaturated carboxylic acids such as oleic acid, from the viewpoint of the rust-preventing property and solubility in base oils, while from the viewpoint of oxidation stability, solubility in base oils and stain resistance, there are preferred C18-22 branched saturated carboxylic acids such as isostearic acid, and especially isostearic acid.

In a partial ester of a polyhydric alcohol and a carboxylic acid, the proportion of unsaturated carboxylic acids in the constituent carboxylic acids is preferably 5-95% by mass. The rust-preventing property and storage stability can be further improved with an unsaturated carboxylic acid proportion of 5% by mass or greater. For the same reason, the proportion of unsaturated carboxylic acids is more preferably 10% by mass or greater, even more preferably 20% by mass or greater, yet more preferably 30% by mass or greater and most preferably 35% by mass or greater. On the other hand, an unsaturated carboxylic acid proportion of greater than 95% by mass will tend to result in an inadequate atmospheric exposure property and poor solubility in base oils. For the same reason, the proportion of unsaturated carboxylic acids is more preferably no greater than 80% by mass, even more preferably no greater than 60% by mass and most preferably no greater than 50% by mass.

Unsaturated carboxylic acids include both unsaturated carboxylic acids with hydroxyl groups and unsaturated carboxylic acids without hydroxyl groups, but the proportion of unsaturated carboxylic acids without hydroxyl groups with respect to the total unsaturated carboxylic acids is preferably 80% by mass or greater, more preferably 90% by mass or greater and even more preferably 95% by mass or greater.

When the partial ester is a partial ester with a proportion of unsaturated carboxylic acids which is 5-95% by mass of the constituent carboxylic acids, the iodine value of the partial ester is preferably 5-75, more preferably 10-60 and even more preferably 20-45. If the iodine value of the partial ester is less than 5, the rust-preventing property and storage stability will tend to be reduced. If the iodine value of the partial ester exceeds 75, the atmospheric exposure property and solubility in base oils will tend to be reduced. The "iodine value" for the purpose of the invention is the iodine value measured by the indicator titration method according to JIS K 0070, "The methods for acid value, saponification value, ester value, iodine value, hydroxyl value and unsaponifiable matter of chemical products".

A (B3-2) esterified oxidized wax is obtained by reaction between an oxidized wax and an alcohol for esterification of all or a portion of the acidic groups of the oxidized wax. Examples of oxidized waxes to be used as starting materials for esterified oxidized waxes include any oxidized waxes, and alcohols include C1-20 straight-chain or branched saturated monohydric alcohols, C1-20 straight-chain or branched unsaturated monohydric alcohols, polyhydric alcohols mentioned above in regard to esters, and alcohols obtained by hydrolysis of lanolin.

A (B3-3) esterified lanolin fatty acid is obtained by reacting an alcohol with a lanolin fatty acid that has been obtained by purification of a waxy substance that adheres to sheep wool, by hydrolysis or the like. Alcohols to be used as starting materials for the esterified lanolin fatty acid include the alcohols mentioned above for the esterified oxidized wax, among which polyhydric alcohols are preferred, and trimethylolpropane, trimethylolethane, sorbitan, pentaerythritol and glycerin are more preferred. Alkyl or alkenylsuccinic acid esters include the aforementioned esters of alkyl or alkenylsuccinic acids and monohydric alcohols or divalent or greater polyhydric alcohols. Preferred among these are esters of monohydric alcohols or dihydric alcohols.

Examples of (B4) amines include the amines mentioned above for the aforementioned sulfonic acid salts. Monoamines are preferred amines for satisfactory stain resistance, while preferred monoamines are alkylamines and monoamines with alkyl and alkenyl groups, monoamines with alkyl and cycloalkyl groups, among which cycloalkylamines and alkylcycloalkylamines are more preferred. From the viewpoint of satisfactory stain resistance, amines with a total of 3 or more carbon atoms and especially amines with a total of 5 or more carbon atoms in the amine molecule, are preferred.

Any (B5) carboxylic acid may be used, but preferred are fatty acids, dicarboxylic acids, hydroxy fatty acids, naphthenic acids, resin acids, oxidized waxes and lanolin fatty acids. There are no particular restrictions on the number of carbon atoms of the fatty acid, but it is preferably 6-24 and more preferably 10-22. The fatty acid may be a saturated fatty acid or unsaturated fatty acid, and either a straight-chain fatty acid or a branched-chain fatty acid, or a mixture thereof. All substituted isomers of these fatty acids may also be mentioned.

A dicarboxylic acid used is preferably a C2-40 dicarboxylic acid and more preferably a C5-36 dicarboxylic acid. Of these, it is preferred to use dimer acids that are dimers of C6-18 unsaturated fatty acids, and alkyl or alkenylsuccinic acids. Examples of dimer acids include dimer acids of oleic acid. Among alkyl or alkenylsuccinic acids there are preferred alkenylsuccinic acids, and more preferably alkenylsuccinic acids with C8-18 alkenyl groups.

A hydroxy fatty acid used is preferably a C6-24 hydroxy fatty acid. The hydroxy fatty acid may have a single hydroxy group or more than one, but it preferably has 1-3 hydroxy groups. Examples of such hydroxy fatty acids include ricinolic acid.

A naphthenic acid is a carboxylic acid present in petroleum, having a —COOH group bonded to a naphthene ring. A resin acid is an organic acid present in free form or as an ester in a natural resin. An oxidized wax is obtained by oxidation of a wax. There are no particular restrictions on waxes used as starting materials, and specifically they include paraffin waxes, microcrystalline waxes and petrolatum obtained during purification of petroleum fractions, and polyolefin waxes obtained by synthesis.

A lanolin fatty acid is a carboxylic acid obtained by purification of a waxy substance that adheres to sheep wool, by hydrolysis.

Of these carboxylic acids, dicarboxylic acids are preferred, dimer acids are more preferred and dimer acids of oleic acid are even more preferred, from the viewpoint of the rust-preventing property, degreasing property and storage stability.

A (B6) fatty acid amine salt is a salt of a fatty acid mentioned above in the explanation of carboxylic acids, and an amine mentioned above in the explanation of amines.

A (B7) carboxylic acid salt may be an alkali metal salt, alkaline earth metal salt or amine salt of the aforementioned carboxylic acids. Alkali metals for carboxylic acid salts include sodium and potassium, and alkaline earth metals include barium, calcium and magnesium. Calcium salts are preferably used. The amines mentioned above in the explanation of amines may be used as amines. With barium salts, however, inadequate safety for the body and ecological systems may be a concern.

Examples of (B8) paraffin waxes include paraffin waxes, microcrystalline waxes and petrolatum obtained during purification of petroleum fractions, and polyolefin waxes obtained by synthesis.

There are no particular restrictions on oxidized waxes to be used as starting materials for a (B9) oxidized wax salt, and examples include oxidized paraffin waxes produced by oxidation of waxes such as the paraffin waxes mentioned above.

When the oxidized wax salt is an alkali metal salt, the alkali metal used as the starting material may be sodium, potassium or the like. When the oxidized wax salt is an alkaline earth metal salt, the alkaline earth metal used as the starting material may be magnesium, calcium, barium or the like. When the oxidized wax salt is a heavy metal salt, the heavy metal used as the starting material may be zinc, lead or the like. Calcium salts are preferred among these. From the viewpoint of safety for the body and ecological systems, the oxidized wax salt is preferably not a barium salt or heavy metal salt.

A (B10) alkyl or alkenylsuccinic acid derivative may be an ester of an alkyl or alkenylsuccinic acid and an alcohol, the reaction product of an alkyl or alkenylsuccinic acid and an aminoalkanol, the reaction product of an alkyl or alkenylsuccinic anhydride and a sarcosine, or the reaction product of an alkyl or alkenylsuccinic anhydride and a dimer acid.

Preferred for use among these for component (B10) are partial esters (monoesters) of alkenylsuccinic acids and alcohols. The alkenyl group may have any number of carbon atoms, but usually a C8-18 group will be used. The alcohol composing a partial ester may be a monovalent alcohol or a dihydric or greater polyhydric alcohol, but monohydric alcohols and dihydric alcohols are preferred. C8-18 aliphatic alcohols may generally be used as monohydric alcohols. They may be straight-chain or branched, and either saturated or unsaturated. Alkylene glycols and polyoxyalkylene glycols may generally be used as dihydric alcohols.

A (B11) boron compound may be potassium borate, calcium borate or the like.

In the rust preventive oil composition of the invention, one of components (B1)-(B11) mentioned above may be used alone as the rust preventive additive, or a mixture of two or more types of the same rust preventive additive may be used, or a mixture of two or more types of different rust preventive additives may be used, although a (B1) sarcosine compound is preferably an essential component. The (B1) sarcosine compound used may be of a single type or a combination of two or more types, and components (B2)-(B11) may also be used alone or in combinations of two or more.

Rust preventive additives to be used in the composition of the invention are preferably sulfonates or esters, and more preferably combinations of sulfonates and esters, from the viewpoint of exhibiting a more excellent rust-preventing property under conditions in which water is copresent.

In addition to the rust preventive additives mentioned above, there may be added rust preventive additives including alcohols such as higher aliphatic alcohols; and phosphoric acid derivatives and phosphorous acid derivatives including amine salts of phosphoric acid monoesters, phosphoric acid diesters, phosphorous acid esters, phosphoric acid and phosphorous acid.

There are no particular restrictions on the content of other rust preventive additives used in the rust preventive oil composition of the invention in addition to the (B1) sarcosine compound, (B5) carboxylic acid and (B10) alkyl or alkenylsuccinic acid derivative, among the rust preventive additives (B1)-(B11), but from the viewpoint of the rust-preventing property it is preferably 0.1% by mass or greater, more preferably 0.5% by mass or greater and even more preferably 1.0% by mass or greater based on the total amount of the composition. Also, from the viewpoint of storage stability, the content of other rust preventive additives used in addition to the (B1) sarcosine compound, (B5) carboxylic acid and (B10) alkyl or alkenylsuccinic acid derivative, among the rust preventive additives (B1)-(B11), is preferably no greater than 20% by mass, more preferably no greater than 15% by mass and even more preferably no greater than 10% by mass, based on the total amount of the composition.

There are no particular restrictions on the content of the (B5) carboxylic acid as a rust preventive additive in the rust preventive oil composition of the invention, among components (B1)-(B11), but from the viewpoint of the rust-preventing property it is preferably 0.01% by mass or greater, more preferably 0.03% by mass or greater and even more preferably 0.05% by mass or greater based on the total amount of the composition. If the carboxylic acid content is less than this lower limit, the improving effect of addition on the rust-preventing property may be inadequate. The carboxylic acid content is preferably no greater than 2% by mass, more preferably no greater than 1.5% by mass and even more preferably no greater than 1% by mass, based on the total amount of the composition. If the carboxylic acid content exceeds this upper limit, the solubility in base oils may be insufficient, lowering the storage stability.

There are no particular restrictions on the content of the (B1) sarcosine compound used as a rust preventive additive in the rust preventive oil composition of the invention, among components (B1)-(B11), but from the viewpoint of the rust-preventing property it is preferably 0.05% by mass or greater, more preferably 0.1% by mass or greater and even more preferably 0.3% by mass or greater based on the total amount of the composition. If the sarcosine compound content is below this lower limit, the rust-preventing property and its long-term maintenance will tend to be insufficient. The sarcosine compound content is preferably no greater than 10% by mass, more preferably no greater than 7% by mass and even more preferably no greater than 3% by mass, based on the total amount of the composition. Even if the sarcosine compound content exceeds this upper limit, there will tend to be no further improving effect on the rust-preventing property or its long-term maintenance that is commensurate with the content.

There are no particular restrictions on the content of a (B10) alkyl or alkenylsuccinic acid derivative used as a rust preventive additive in the rust preventive oil composition of the invention, among the rust preventive additives (B1)-(B11), but from the viewpoint of the rust-preventing property it is preferably 0.01% by mass or greater, more preferably 0.03% by mass or greater and even more preferably 0.05% by mass or greater based on the total amount of the composition. If the alkyl or alkenylsuccinic acid derivative is less than this lower limit, the improving effect on the rust-preventing property by the addition may be inadequate. The alkyl or alkenylsuccinic acid derivative content is also preferably no greater than 2% by mass, more preferably no greater than 1.5% by mass and even more preferably no greater than 1% by mass, based on the total amount of the composition. If the alkyl or alkenylsuccinic acid derivative content exceeds this upper limit, no further effect will be obtained that is commensurate with the content.

A chlorine-based bleaching agent will sometimes be used during production of the rust preventive additive for decoloration, and according to the invention, a non-chlorine-based compound such as hydrogen peroxide is preferably used as the bleaching agent, or no decoloration treatment is carried out. Chlorine-based compounds such as hydrochloric acid are sometimes used in hydrolysis of fats or oils, and in such cases as well, it is preferred to use a non-chlorine-based acid or a basic compound. The obtained compound is preferably subjected to adequate washing treatment such as rinsing. The chlorine concentration of the rust preventive additive is not particularly restricted so long as the properties of the composition of the invention are not impaired, but it is preferably no greater than 200 ppm by mass, more preferably no greater than 100 ppm by mass, even more preferably no greater than 50 ppm and most preferably no greater than 25 ppm by mass.

The 40° C. kinematic viscosity of the rust preventive oil composition of the invention is 1-50 $mm^2/s$, preferably 2-45 $mm^2/s$, more preferably 3-40 $mm^2/s$ and even more preferably 4-30 $mm^2/s$. If the 40° C. kinematic viscosity is less than 1 $mm^2/s$ it will not be possible to maintain an oil film, and problems with the rust-preventing property may arise. If the 40° C. kinematic viscosity exceeds 50 $mm^2/s$, the degreasing property and manageability (spray atomizing property and increased stickiness) may be reduced.

The rust preventive oil composition of the invention which comprises a nonionic surfactant absorbs moisture in the air during the course of use, so that a greater rust preventive effect is exhibited. On the other hand, water may be pre-added at the time of use of the rust preventive oil composition. The water used may be industrial water, tap water, ion-exchanged water, distilled water, water treated with active carbon or a common household water purifier, or water obtained by absorbing moisture in the air.

The water content, when water is added to the rust preventive oil composition of the invention, is preferably in the range of 0.1-10% by mass based on the total amount of the composition. From the viewpoint of inhibiting rust generation, the water content is preferably at least 0.1% by mass, more preferably at least 0.5% by mass and most preferably at least 1.0% by mass. The upper limit for the content is preferably no greater than 10% by mass and more preferably no greater than 5% by mass, from the viewpoint of minimizing rust generation and exhibiting stability against separation.

There are no particular restrictions on the method of adding the water, and it may be, for example, (1) a method of premixing a surfactant and water and adding the mixture to a base oil, (2) a method of adding a surfactant to a base oil and then adding water, (3) a method of using a stirring apparatus such as a homogenizer for forced mixing and dispersion of water, (4) a method of blowing steam into a base oil for forcible mixing and dispersion of water, or (5) a method of coating a metal member with the rust preventive oil composition of the invention and then allowing natural absorption of moisture in the air.

The base value of the rust preventive oil composition of the invention is preferably 0.5 mgKOH/g or greater, more preferably 1.5 mgKOH/g or greater and even more preferably 3.0 mgKOH/g or greater, from the viewpoint of the rust-preventing property. From the viewpoint of storage stability, the base value is preferably no greater than 30 mgKOH/g, more preferably no greater than 20 mgKOH/g and even more preferably no greater than 15 mgKOH/g. The base value referred to here is the base value (mgKOH/g) determined by the hydrochloric acid method, as measured according to JIS K2501: "Petroleum products and lubricants—Determination of neutralization number", Section 6.

Other additives may also be added as necessary to the rust preventive oil composition of the invention. Specific examples include paraffin waxes and petrolatum which have notable effects of improving the rust-preventing property under exposure to acidic atmospheres; sulfurized fats and oils, sulfurized esters which have notable effects of improving press moldability and effects of improving lubricity; long-chain alkyl zinc dithiophosphates, phosphoric acid esters such as tricresyl phosphate, fats and oils such as lard, fatty acids, higher alcohols, calcium carbonate and potassium borate; phenol-based or amine-based antioxidants for improved anti-oxidation performance; corrosion inhibitors including benzotriazole and its derivatives, thiadiazole and benzothiazole, for improved corrosion-inhibiting performance; moistening agents such as diethyleneglycol monoalkyl ether; film-forming agents such as acrylic polymers and slack waxes; antifoaming agents such as methylsilicone, fluorosilicone and polyacrylate, surfactants, and mixtures of the foregoing. The content of such other additives may be as desired, but the total content of such additives is preferably no greater than 10% by mass based on the total amount of the composition of the invention.

The chlorine and lead contents in the rust preventive oil composition of the invention are each preferably no greater than 1000 ppm by mass, more preferably no greater than 500 ppm by mass, even more preferably no greater than 100 ppm by mass, yet more preferably no greater than 50 ppm by mass, even yet more preferably no greater than 10 ppm by mass, especially preferably no greater than 5 ppm by mass and most preferably no greater than 1 ppm by mass, in terms of each element based on the total amount of the composition. If either of these elements has a content exceeding 1000 ppm by mass, the safety for the body and for environments such as ecological systems may not be satisfactory.

The element content, according to the invention, is the value measured by the following methods. Specifically, this is each content (ppm by mass) based on the total amount of the composition, measured according to ASTM D 5185-95 "Standard Test Method for Determination of Additive Elements, Wear Metals, and Contaminants in Used Lubricating Oils and Determination of Selected Elements in Base Oils by Inductively Coupled Plasma Atomic Emission Spectrometry (ICP-AES)" for lead, and "IP PROPOSED METHOD AK/81 Determination of chlorine microcoulometry oxidative method" for chlorine. The detection limit for each element in the measuring methods mentioned above is usually 1 ppm by mass.

The rust preventive oil composition of the invention can provide a high level of balance between the rust-preventing property and storage stability, and it can be suitably used as a rust preventive oil for a variety of metal members. In particular, the rust-preventing property was such that excellent performance was maintained whereby the maintenance time for Grade A rust generation (rust generation of 0%) in the wet test specified by JIS K 2246 "Rust preventive oils" was 1000 hours or longer, which is not found in the prior art.

There are no particular restrictions on the metal member which is to be treated, and specifically, it may be a surface-treated steel sheet such as a cold-rolled steel sheet, hot-rolled steel sheet, high-strength steel plate or galvanized steel sheet, to serve in an automobile body or electrical product body, a metal sheet material such as a tinning sheet, aluminum alloy sheet or magnesium alloy sheet, or a bearing part such as an antifriction bearing, tapered antifriction bearing or needle bearing, construction steel, a precision part, or the like.

Rust preventive oils for such metal members include intermediate rust preventive oils used during the processes of working of metal members, and shipping rust preventive oils used to prevent rusting during shipping, and the rust preventive oil composition of the invention can be applied for all such purposes.

There are no particular restrictions on the method of coating the rust preventive oil composition of the invention onto an article to be treated, and for example, it may be coated onto a metal member by spraying, dropping, transfer with a felt material or the like, or electrostatic lubrication. Of these coating methods, spraying is preferred as it allows a uniform oil film thickness to be obtained by application as a fine mist. The coating applicator used for application by spraying is not particularly restricted so long as it can atomize the composition of the invention, and an air spray type, airless spray type or hot-melt type may be used, for example. In the application step, application of an excess of the rust preventive oil composition is preferably followed by a step of draining using a centrifugal separator, or a step of draining by prolonged standing.

Regardless of the application method used for the composition of the invention, the rust preventive oil composition that has been coated in excess on the metal member is preferably recovered, circulated and reused. During circulation of the composition of the invention, it is preferred to remove the contaminants present in the circulating system. For example, a filter may be provided for removal of the contaminants, in the circulation pathway of the composition of the invention, and preferably immediately after the composition of the invention has been sprayed toward the metal member. A magnet may also be provided at the bottom section of the reservoir tank for the composition of the invention, to allow removal of contaminants such as abrasion dust by magnetic force.

The performance of the composition of the invention that is reused in this step can be impaired by contamination of the oil in this step. For reuse of the composition of the invention, therefore, it is preferred to conduct periodic measurement of the kinematic viscosity or density of the used oil, copper sheet corrosion testing and rust-preventing property testing to manage the properties, and if necessary, to also carry out oil renewal, drain disposal, tank cleaning and oil purification.

EXAMPLES

The present invention will now be explained in greater detail based on examples and comparative examples, with the understanding that these examples are in no way limitative on the invention.

Examples 1-20 and Comparative Examples 1-9

There were prepared rust preventive oil compositions of the invention, having the compositions of Examples 1-20 listed in Tables 1-4, and rust preventive oil compositions for Comparative Examples 1-9, listed in Tables 5 and 6. The components used to prepare each composition were as follows.

Component (A)

A1: Ethylene oxide addition product of laurylamine (number of moles of EO addition: 3, hydrophilic-lipophilic index: 9.3)

A2: Ethylene oxide addition product of stearylamine (number of moles of EO addition: 6, hydrophilic-lipophilic index: 10.5)

A3: Ethylene oxide addition product of monocyclohexylamine (number of moles of EO addition: 2, hydrophilic-lipophilic index: 11.1)

A4: Ethylene oxide addition product of laurylamine (number of moles of EO addition: 5, hydrophilic-lipophilic index: 11.7)

A5: Ethylene oxide addition product of monocyclohexylamine (number of moles of EO addition: 4, hydrophilic-lipophilic index: 13.9)

A6: Ester of arachic acid and sorbitan (hydrophilic-lipophilic index: 8.2)

A7: Ester of laurylic acid and sorbitan (hydrophilic-lipophilic index: 10.9)

A8: Ester of capric acid and sorbitan (hydrophilic-lipophilic index: 11.9)

A9: Ester of caproic acid and sorbitan (hydrophilic-lipophilic index: 14.5)

Component (B)

B1: Oleoyl sarcosine (N-oleoyl-N-methylglycin)

B2-1: Ethylenediamine sulfonate

B2-2: Na dinonylnaphthalenesulfonate

B2-3: Neutral Ca sulfonate

B2-4: Neutral Ba sulfonate

B3-1: Sorbitan monoisostearate

B3-2: Succinic acid ester (half ester of propylene glycol and alkenylsuccinic acid with C12 alkenyl group)

B4: Dicyclohexylamine

B5: Dimer acid of oleic acid

B6: Salt of octanoic acid and octylamine

B7: Calcium salt of lanolin fatty acid

B8: Paraffin wax with melting point of 46° C.

B9: Calcium salt of oxidized wax (C) Other Additives

C1: di-t-Butyl-p-cresol as antioxidant

C2: Benzotriazole as metal inactivating agent

Component (D)

D1: Water (distilled water)

Component (E)

E1: Mineral oil with 40° C. kinematic viscosity of 0.75 $mm^2/s$

E2: Mineral oil with 40° C. kinematic viscosity of 22 $mm^2/s$

E3: Mineral oil with 40° C. kinematic viscosity of 480 $mm^2/s$

E4: Synthetic oil (poly α-olefin: 40° C. kinematic viscosity: 21 $mm^2/s$)

[Test Methods]

<Kinematic Viscosity>

Measurement was conducted according to JIS K 2283.

<Rust-Preventing Property Test-1 (Wet Test)>

Evaluation was conducted according to JIS K 2246-2007 "Rust preventive oils", 6.34, "Wet test method". The time (h) until the rust generation of Grade A (rust generation of 0%) was maintained was measured and evaluated.

<Rust-Preventing Property Test-2 (Neutral Salt Spray Test)>

Evaluation was conducted according to JIS K2246-2007 "Rust preventive oils", 6.35, "Neutral salt spray test". The time (h) until rust was generated was measured and evaluated, with evaluation conducted each 1 hour.

<Rust-Preventing Property Test-3 (Rust-Preventing Property Test)>

The test was carried out by the following steps.

(1) A cleaned test piece (the same as for the wet test method) was printed with an artificial fingerprint solution according to JIS K 2246-2007, 6.31 "Fingerprint removability test".

(2) The fingerprint-printed test piece was dipped in sample oil for coating, and the oil was drained for 24 hours.

(3) The test piece was placed in a suspended state by the same procedure as in the wet test, and kept for 2 weeks in a high-humidity thermostatic bath adjusted to 50° C., 95% relative humidity.

Upon completion of this step, the presence or absence of rust generation was evaluated. Rust generation was indicated by "+", and lack of rust generation was indicated by "−".

<Separation Stability>

After preparing the rust preventive oil composition, it was held for 24 h in a thermostatic bath adjusted to 25° C., and the presence or absence of water separation was evaluated. Lack of water separation was indicated by "−", and water separation was indicated by "+".

<Moisture Absorption Test>

A 10 g portion of sample oil was placed in a 200 ml glass container and allowed to stand for 16 h in a thermostatic bath adjusted to 30° C., 80% RH, upon which the moisture content was measured.

Moisture measuring method: Karl Fischer method according to JIS K2275 (using moisture vaporizer).

The test results are shown in Tables 1 to 6.

TABLE 1

| | | Example 1 | Example 2 | Example 3 | Example 4 | Example 5 |
|---|---|---|---|---|---|---|
| Composition, % by mass | Component (A) A1 | | | | | |
| | A2 | | | | 3.0 | |
| | A3 | 0.8 | 3.0 | 10.0 | | |
| | A4 | | | | | 3.0 |
| | A5 | | | | | |
| | A6 | | | | | |
| | A7 | | | | | |
| | A8 | | | | | |
| | A9 | | | | | |

TABLE 1-continued

| | | Example 1 | Example 2 | Example 3 | Example 4 | Example 5 |
|---|---|---|---|---|---|---|
| Component (B) | B1 | 1.0 | 1.0 | 1.0 | 1.0 | 1.0 |
| | B2-1 | 5.0 | 5.0 | 5.0 | 5.0 | 5.0 |
| | B2-2 | | | | | |
| | B2-3 | | | | | |
| | B2-4 | | | | | |
| | B3-1 | 5.0 | 5.0 | 5.0 | 5.0 | 5.0 |
| | B3-2 | 1.0 | 1.0 | 1.0 | 1.0 | 1.0 |
| | B4 | | | | | |
| | B5 | | | | | |
| | B6 | | | | | |
| | B7 | | | | | |
| | B8 | 1.0 | 1.0 | 1.0 | 1.0 | 1.0 |
| | B9 | | | | | |
| Component (C) | C1 | 0.5 | 0.5 | 0.5 | 0.5 | 0.5 |
| | C2 | | | | | |
| Component (D) | Water | 3.0 | 3.0 | 3.0 | 3.0 | 3.0 |
| Component (E) | E1 | 62.7 | 60.5 | 53.5 | 60.5 | 60.5 |
| | E2 | 15.0 | 15.0 | 15.0 | 15.0 | 15.0 |
| | E3 | 5.0 | 5.0 | 5.0 | 5.0 | 5.0 |
| | E4 | | | | | |
| 40° C. Kinematic viscosity | ($mm^2/s$) | 5.5 | 6.0 | 6.2 | 6.2 | 5.9 |
| Moisture after hygroscopic test | (ppm by mass.) | – | – | – | – | – |
| Rust-preventing property test-1 | (h) | ≥1000 | ≥1000 | ≥1000 | ≥1000 | ≥1000 |
| Rust-preventing property test-2 | (h) | ≥48 | ≥48 | ≥48 | ≥48 | ≥48 |
| Rust-preventing property test-3 | | – | – | – | – | – |
| Separation stability | | – | – | – | – | – |

TABLE 2

| | | | Example 6 | Example 7 | Example 8 | Example 9 | Example 10 |
|---|---|---|---|---|---|---|---|
| Composition, % by mass | Component (A) | A1 | | | | | |
| | | A2 | | | | | |
| | | A3 | | | 3.0 | 3.0 | 3.0 |
| | | A4 | | | | | |
| | | A5 | | | | | |
| | | A6 | | | | | |
| | | A7 | 3.0 | | | | |
| | | A8 | | 3.0 | | | |
| | | A9 | | | | | |
| | Component (B) | B1 | 1.0 | 1.0 | 1.0 | 1.0 | 1.0 |
| | | B2-1 | 5.0 | 5.0 | | | 5.0 |
| | | B2-2 | | | 5.0 | | |
| | | B2-3 | | | | 5.0 | |
| | | B2-4 | | | | | |
| | | B3-1 | 5.0 | 5.0 | 5.0 | 5.0 | 5.0 |
| | | B3-2 | 1.0 | 1.0 | 1.0 | 1.0 | 1.0 |
| | | B4 | | | | | |
| | | B5 | | | | | |
| | | B6 | | | | | |
| | | B7 | | | | | |
| | | B8 | 1.0 | 1.0 | 1.0 | 1.0 | 1.0 |
| | | B9 | | | | | |
| | Component (C) | C1 | 0.5 | 0.5 | 0.5 | 0.5 | 0.5 |
| | | C2 | | | | | |
| | Component (D) | Water | 3.0 | 3.0 | 3.0 | 0.0 | 3.0 |
| | Component (E) | E1 | 60.5 | 60.5 | 60.5 | 63.5 | 60.5 |
| | | E2 | 15.0 | 15.0 | 15.0 | 15.0 | |
| | | E3 | 5.0 | 5.0 | 5.0 | 5.0 | 5.0 |
| | | E4 | | | | | 15.0 |
| 40° C. Kinematic viscosity | | ($mm^2/s$) | 6.2 | 6.2 | 6.3 | 5.8 | 6.1 |
| Moisture after hygroscopic test | | (ppm by mass.) | – | – | – | 8000 | – |
| Rust-preventing property test-1 | | (h) | ≥1000 | ≥1000 | ≥1000 | ≥1000 | ≥1000 |
| Rust-preventing property test-2 | | (h) | ≥48 | ≥48 | ≥48 | ≥48 | ≥48 |
| Rust-preventing property test-3 | | | – | – | – | – | – |
| Separation stability | | | – | – | – | – | – |

TABLE 3

| | | | Example 11 | Example 12 | Example 13 | Example 14 | Example 15 |
|---|---|---|---|---|---|---|---|
| Composition, % by mass | Component (A) | A1 | | | | | |
| | | A2 | | | | | |
| | | A3 | 3.0 | 3.0 | 3.0 | 3.0 | 3.0 |
| | | A4 | | | | | |

TABLE 3-continued

| | | Example 11 | Example 12 | Example 13 | Example 14 | Example 15 |
|---|---|---|---|---|---|---|
| | A5 | | | | | |
| | A6 | | | | | |
| | A7 | | | | | |
| | A8 | | | | | |
| | A9 | | | | | |
| Component (B) | B1 | 1.0 | 1.0 | 1.0 | 1.0 | 1.0 |
| | B2-1 | 5.0 | 5.0 | 5.0 | 5.0 | 5.0 |
| | B2-2 | | | | | |
| | B2-3 | | | | | |
| | B2-4 | | | | | |
| | B3-1 | | | | | |
| | B3-2 | | | | | |
| | B4 | 3.0 | | | | |
| | B5 | | 3.0 | | | |
| | B6 | | | 3.0 | | |
| | B7 | | | | 3.0 | |
| | B8 | | | | | 3.0 |
| | B9 | | | | | |
| Component (C) | C1 | 0.5 | 0.5 | 0.5 | 0.5 | 0.5 |
| | C2 | | | | | |
| Component (D) | Water | 3.0 | 3.0 | 3.0 | 3.0 | 3.0 |
| Component (E) | E1 | 64.5 | 64.5 | 64.5 | 64.5 | 64.5 |
| | E2 | 15.0 | 15.0 | 15.0 | 15.0 | 15.0 |
| | E3 | 5.0 | 5.0 | 5.0 | 5.0 | 5.0 |
| | E4 | | | | | |
| 40° C. Kinematic viscosity | ($mm^2/s$) | 5.3 | 5.0 | 5.5 | 5.5 | 5.2 |
| Moisture after hygroscopic test | (ppm by mass.) | – | – | – | – | – |
| Rust-preventing property test-1 | (h) | ≥1000 | ≥1000 | ≥1000 | ≥1000 | ≥1000 |
| Rust-preventing property test-2 | (h) | 24 | 32 | 24 | 32 | 24 |
| Rust-preventing property test-3 | | – | – | – | – | – |
| Separation stability | | – | – | – | – | – |

TABLE 4

| | | Example 16 | Example 17 | Example 18 | Example 19 | Example 20 |
|---|---|---|---|---|---|---|
| Composition, % by mass | Component (A) A1 | | | | | |
| | A2 | | | | | |
| | A3 | 3.0 | 3.0 | 3.0 | 3.0 | 3.0 |
| | A4 | | | | | |
| | A5 | | | | | |
| | A6 | | | | | |
| | A7 | | | | | |
| | A8 | | | | | |
| | A9 | | | | | |
| Component (B) | B1 | 1.0 | 1.0 | 1.0 | 1.0 | 1.0 |
| | B2-1 | 5.0 | | | | |
| | B2-2 | | | | 5.0 | |
| | B2-3 | | 5.0 | 5.0 | | |
| | B2-4 | | | | | 5.0 |
| | B3-1 | | 3.0 | 3.0 | 3.0 | 3.0 |
| | B3-2 | | | | | |
| | B4 | | | | | |
| | B5 | | | | | |
| | B6 | | | | | |
| | B7 | | | | | |
| | B8 | | | | | |
| | B9 | 3.0 | 3.5 | 3.5 | | |
| Component (C) | C1 | 0.5 | 0.5 | 0.5 | 0.5 | 0.5 |
| | C2 | | | 0.5 | | |
| Component (D) | Water | 3.0 | 0.0 | 0.0 | 0.0 | 0.0 |
| Component (E) | E1 | 64.5 | 64 | 63.5 | 67.5 | 67.5 |
| | E2 | 15.0 | 15.0 | 15.0 | 15.0 | 15.0 |
| | E3 | 5.0 | 5.0 | 5.0 | 5.0 | 5.0 |
| | E4 | | | | | |
| 40° C. Kinematic viscosity | ($mm^2/s$) | 5.4 | 6.2 | 6.2 | 5.8 | 6.4 |
| Moisture after hygroscopic test | (ppm by mass.) | – | 8500 | 8800 | 11000 | 7800 |
| Rust-preventing property test-1 | (h) | ≥1000 | ≥1000 | ≥1000 | ≥1000 | ≥1000 |
| Rust-preventing property test-2 | (h) | 32 | 48 | 48 | 32 | 48 |
| Rust-preventing property test-3 | | – | – | – | – | – |
| Separation stability | | – | – | – | – | – |

TABLE 5

| | | | Comp. Ex. 1 | Comp. Ex. 2 | Comp. Ex. 3 | Comp. Ex. 4 |
|---|---|---|---|---|---|---|
| Composition, % by mass | Component (A) | A1 | | 3.0 | | |
| | | A2 | | | | |
| | | A3 | 3.0 | | | |
| | | A4 | | | | |
| | | A5 | | | 3.0 | |
| | | A6 | | | | 3.0 |
| | | A7 | | | | |
| | | A8 | | | | |
| | | A9 | | | | |
| | Component (B) | B1 | | 1.0 | 1.0 | 1.0 |
| | | B2-1 | | 5.0 | 5.0 | 5.0 |
| | | B2-2 | | | | |
| | | B2-3 | | | | |
| | | B2-4 | | | | |
| | | B3-1 | | 5.0 | 5.0 | 5.0 |
| | | B3-2 | | 1.0 | 1.0 | 1.0 |
| | | B4 | | | | |
| | | B5 | | | | |
| | | B6 | | | | |
| | | B7 | | | | |
| | | B8 | | 1.0 | 1.0 | 1.0 |
| | | B9 | | | | |
| | Component (C) | C1 | 0.5 | 0.5 | 0.5 | 0.5 |
| | | C2 | | | | |
| | Component (D) | Water | 3.0 | 3.0 | 3.0 | 3.0 |
| | Component (E) | E1 | 72.5 | 60.5 | 60.5 | 60.5 |
| | | E2 | 15.0 | 15.0 | 15.0 | 15.0 |
| | | E3 | 5.0 | 5.0 | 5.0 | 5.0 |
| | | E4 | | | | |
| 40° C. Kinematic viscosity | | ($mm^2/s$) | 1.6 | 6.1 | 6.3 | 6.0 |
| Moisture after hygroscopic test | | (ppm by mass.) | – | – | – | – |
| Rust-preventing property test-1 | | (h) | – | ≥1000 | ≥1000 | ≥1000 |
| Rust-preventing property test-2 | | (h) | ≤1 | 48 | 48 | 48 |
| Rust-preventing property test-3 | | | + | + | + | + |
| Separation stability | | | – | – | – | – |

TABLE 6

| | | | Comp. Ex. 5 | Comp. Ex. 6 | Comp. Ex. 7 | Comp. Ex. 8 | Comp. Ex. 9 |
|---|---|---|---|---|---|---|---|
| Composition, % by mass | Component (A) | A1 | | | | | |
| | | A2 | | | | | |
| | | A3 | | 3.0 | 3.0 | 3.0 | |
| | | A4 | | | | | |
| | | A5 | | | | | |
| | | A6 | | | | | |
| | | A7 | | | | | |
| | | A8 | | | | | |
| | | A9 | | | | | 3.0 |
| | Component (B) | B1 | 1.0 | | | | 1.0 |
| | | B2-1 | 5.0 | 5.0 | 5.0 | 5.0 | 5.0 |
| | | B2-2 | | | | | |
| | | B2-3 | | | | | |
| | | B2-4 | | | | | |
| | | B3-1 | 5.0 | 5.0 | | | 5.0 |
| | | B3-2 | 1.0 | 1.0 | | | 1.0 |
| | | B4 | | | | | |
| | | B5 | | | 3.0 | 3.0 | |
| | | B6 | | | | | |
| | | B7 | | | | | |
| | | B8 | 1.0 | 1.0 | | | 1.0 |
| | | B9 | | | | | |
| | Component (C) | C1 | 0.5 | 0.5 | 0.5 | 0.5 | 0.5 |
| | | C2 | | | | | |
| | Component (D) | Water | 3.0 | 3.0 | 3.0 | 3.0 | 3.0 |
| | Component (E) | E1 | 63.5 | 61.5 | 84.5 | 0.5 | 6.05 |
| | | E2 | 15.0 | 20.0 | | | 15.0 |
| | | E3 | 5.0 | 0.0 | 1.0 | 85.0 | 5.0 |
| | | E4 | | | | | |
| 40° C. Kinematic viscosity | | ($mm^2/s$) | 5.9 | 5.1 | 0.88 | 61 | 6.1 |
| Moisture after hygroscopic test | | (ppm by mass.) | – | – | – | – | – |
| Rust-preventing property test-1 | | (h) | ≥1000 | 480 | – | – | ≥1000 |
| Rust-preventing property test-2 | | (h) | 48 | 8 | 2 | – | ≥48 |
| Rust-preventing property test-3 | | | + | – | + | – | + |
| Separation stability | | | + | – | – | + | – |

INDUSTRIAL APPLICABILITY

The present invention may be used as a rust preventive oil composition, and especially to allow prolonged prevention of rust generation on metal parts that are to be supplied for heat treatment, and it exhibits satisfactory performance.

The invention claimed is:

1. A rust preventive oil composition comprising:

a lubricant base oil in an amount of at least 70% by mass based on the total amount of the composition, water in an amount of 0.1-10% by mass based on the total amount of the composition, a nonionic surfactant with a hydrophilic-lipophilic index of 10-12 and with an amount of 0.1-10% by mass based on the total amount of the composition, a sarcosine compound in an amount from 0.05% to 10% by mass based on the total amount of the composition, and at least one rust-preventing additive selected from among sulfonic acid salts, esters, amines, carboxylic acids, fatty acid amine salts, carboxylic acid salts, paraffin waxes, oxidized wax salts, alkyl or alkenylsuccinic acid derivatives and boron compounds, the composition having a 40° C. kinematic viscosity of 1-50 $mm^2/s$.

2. A rust preventive oil composition according to claim 1, wherein the lubricant base oil comprises a mineral oil and/or synthetic oil with a 40° C. kinematic viscosity of 0.7-40 $mm^2/s$, and a mineral oil and/or synthetic oil with a 40° C. kinematic viscosity of 150-700 $mm^2/s$.

3. A rust preventive oil composition according to claim 1, wherein the nonionic surfactant is at least one selected from among ethylene glycol-type nonionic surfactants, polyethylene glycol-type nonionic surfactants and polyhydric alcohol-type nonionic surfactants.

4. A rust preventive oil composition according to claim 1, wherein the nonionic surfactant is at least one selected from among sorbitan fatty acid esters or oxyethylenealkylamines and polyoxyethylenealkylamines represented by the following formula (1):

$$R_a—N—[(C_2H_4O)_b—H]_c \quad (1)$$

wherein R represents a C1-24 hydrocarbon group, a and c are each 1 or 2, with the proviso that a+c=3, and b represents an integer of 1-7.

5. A rust preventive oil composition according to claim 1, comprising a sulfonic acid salt as a rust-preventing additive, wherein the sulfonic acid salt is at least one selected from among amine sulfonate, sodium sulfonate, calcium sulfonate and barium sulfonate.

6. A rust preventative oil composition according to claim 1, wherein the sarcosine compound has a structure represented by one of the following formulae (2), (3), or (4):

$$R^1—CO—NR^2—(CH_2)_n—COOX \quad (2)$$

$$[R^1—CO—NR^2—(CH_2)_n—COO]_mY \quad (3)$$

$$[R^1—CO—NR^2—(CH_2)_n—COO]_m—Z—(OH)_{m'} \quad (4)$$

wherein $R^1$ represents a C6-C30 alkyl or a C6-C30 alkenyl group; $R^2$ represents a C1-C4 alkyl group; X represents hydrogen, a C1-C30 alkyl, or a C1-C30 alkenyl group; Y represents an alkali metal or an alkaline earth metal; Z represents a residue remaining after removal of a hydroxyl group from a divalent or greater polyhydric alcohol; m represents an integer of 1 or greater, which is 1 when Y is an alkali metal and 2 when Y is an alkaline earth metal; m'represents an integer of zero or greater; n represents an integer of 1 to 4, and m+m' is the valency of Z.

7. A rust preventive oil composition according to claim 6, wherein the sarcosine compound has a structure represented by formula (2), wherein $R^1$ represents a C6-C30 alkyl or a C6-C30 alkenyl group; $R^2$ represents a C1-C4 alkyl group; X represents hydrogen, a C1-C30 alkyl, or a C1-C30 alkenyl group; and n represents an integer of 1 to 4.

* * * * *